US007150794B2

(12) United States Patent
De Mendonca Ferreira et al.

(10) Patent No.: US 7,150,794 B2
(45) Date of Patent: Dec. 19, 2006

(54) PROCESS FOR THE PRODUCTION OF CRYSTALLINE FRUCTOSE OF HIGH PURITY UTILIZING FRUCTOSE SYRUP HAVING A LOW CONTENT OF FRUCTOSE MADE FROM SUCROSE AND PRODUCT OBTAINED

(75) Inventors: João Afonso De Mendonca Ferreira, Niterói (BR); Cláudio Otávio Mattos Teixeira, Rio de Janeiro (BR); Sérgio Murilo Stamile Soares, Rio de Janeiro (BR)

(73) Assignee: Getec Guanabara Quimica Industrial S.A., Sao Goncalo (BR)

( * ) Notice: Subject to any disclaimer, the term of this patent is extended or adjusted under 35 U.S.C. 154(b) by 162 days.

(21) Appl. No.: 10/486,516

(22) PCT Filed: May 17, 2002

(86) PCT No.: PCT/BR02/00071

§ 371 (c)(1),
(2), (4) Date: Feb. 12, 2004

(87) PCT Pub. No.: WO03/016577

PCT Pub. Date: Feb. 27, 2003

(65) Prior Publication Data

US 2004/0231662 A1 Nov. 25, 2004

(30) Foreign Application Priority Data

Aug. 15, 2001 (BR) ..... 0103406

(51) Int. Cl.
*C13F 1/02* (2006.01)
*C13K 11/00* (2006.01)

(52) U.S. Cl. ..... 127/61; 127/30; 127/41; 127/46.2; 127/60; 127/62

(58) Field of Classification Search ..... 106/30, 106/41, 46.2, 60, 61, 62
See application file for complete search history.

(56) References Cited

U.S. PATENT DOCUMENTS

| | | | | |
|---|---|---|---|---|
| 3,513,023 | A | 5/1970 | Kusch et al. | |
| 3,607,392 | A | 9/1971 | Lauer et al. | |
| 3,883,365 | A | 5/1975 | Forsberg et al. | |
| 3,928,062 | A | 12/1975 | Yamauchi | |
| 4,199,373 | A | 4/1980 | Dwivedi et al. | |
| 4,199,374 | A | 4/1980 | Dwivedi et al. | |
| 4,405,377 | A * | 9/1983 | Neuzil | 127/46.2 |

(Continued)

FOREIGN PATENT DOCUMENTS

EP 0613954 A1 9/1994

OTHER PUBLICATIONS

Hanover et al., Am. J. Clin. Nutr., vol. 58, pp. 724S-732S, (1993).

(Continued)

*Primary Examiner*—David M. Brunsman
(74) *Attorney, Agent, or Firm*—Birch, Stewart, Kolasch & Birch, LLP

(57) ABSTRACT

Crystalline fructose, from sugar cane sucrose, having particles composed of microcrystals which exhibit a narrow size distribution with a mean diameter of 250 to 350 microns. A process comprising chemical conversion of sucrose by acid hydrolysis; chromatographic separation of the fructose from the glucose; preparing fructose-rich syrup; crystallization of the fructose from an aqueous alcoholic medium, recovery by centrifugation; washing and; drying of the crystals.

18 Claims, 1 Drawing Sheet

U.S. PATENT DOCUMENTS 4,517,021 A 5/1985 Schollmeier
4,643,773 A 2/1987 Day
4,742,006 A 5/1988 Bringer et al.
4,888,060 A * 12/1989 Niekamp et al. ..... 127/60
4,938,804 A * 7/1990 Heikkila et al. ..... 127/60
5,015,297 A * 5/1991 Patrick et al. ..... 127/58
5,047,088 A 9/1991 Liaw et al.
5,350,456 A 9/1994 Schwab
5,656,094 A 8/1997 Peckous

OTHER PUBLICATIONS

Hocking, M. B., Handbook of Chemical Tech. And Pollution Control, pp. 545-546, (1998).
Belter et al., Bioseparations, Downstream Processing for Biotech., pp. 277-278, (1988).
Astarita, G., Thermodynamics, pp. 149-150, (1989).
Oldshue, J., Fluid Mixing Technology, pp. 239, (1983).

* cited by examiner

PROCESS FOR THE PRODUCTION OF CRYSTALLINE FRUCTOSE OF HIGH PURITY UTILIZING FRUCTOSE SYRUP HAVING A LOW CONTENT OF FRUCTOSE MADE FROM SUCROSE AND PRODUCT OBTAINED

The present invention relates to a process for producing anhydrous crystalline fructose of a high chemical purity through crystallization thereof, which is accomplished by the controlled cooling of an aqueous alcoholic solution of fructose, said fructose being obtained from sugar cane sucrose. The said fructose, manufactured by the process according to the invention, is composed of well defined crystals typical of the orthorhombic crystal system, and is constituted of particles which exhibit a narrow size distribution with a mean diameter comprised between about 250 microns and about 350 microns. The physical and functional characteristics of the anhydrous crystalline fructose according to the invention, such as purity, granulometric size distribution and mean diameter of the microcrystalline granules, apparent density, hygroscopicity, and dissolution time, are carefully adjusted in order to maximize its performance in applications in the food industry. A further object of the present invention is to provide the protection of the product, crystalline fructose, obtained in accordance with the process of the invention.

The technical field of the invention is concerned with naturally occurring nutritive sweeteners, the most important of these being the sucrose, the glucose and the fructose, which are saccharides produced on a large industrial scale and widely consumed as simple sugars and as ingredients in several edible products.

Fructose, also called levulose, is a ketose possessing the molecular formula $C_6H_{12}O_6$ and is a major constituent of many fruits, having a high sweetening power in relation to its weight; according to some data collected from the literature, fructose exhibits a sweetness approximately equal to two times that of sucrose and two and a half times that of glucose when used on an equivalent weight basis (U.S. Pat. No. 4,724,006; M. B. Hocking, Handbook of Chemical Technology and Pollution Control, Academic Press, San Diego, 1998, p. 546). In fact, fructose is the sweetest of all naturally occurring carbohydrates. This feature renders the fructose especially suitable to be employed as a sweetener in a large number of food and beverage products, thus allowing these formulations to be satisfactorily sweetened with small amounts of this monosaccharide, what permits the manufacture of products with reduced calorific values, or dietetic products, especially when compared with similar products formulated with either the sucrose or the glucose, inasmuch as these substances possess calorific values nearly equal to that of fructose. The main reason for the production and ultimate consumption of fructose is its exceptional sweetening power.

Additional properties of the fructose which contribute to the success of its industrial applications include a high humectancy, a high osmotic pressure, a considerable flavor enhancement, a low as well as insulin-independent initial metabolic rate by the liver, and a very high solubility in water. This last property makes it possible to store liquid and semiliquid manufactured edible products sweetened with fructose for long periods of time without any occurrence of crystallization, in contrast to what usually happens when sucrose or glucose are used as sweeteners.

Fructose is employed in the food industry in both the anhydrous crystalline form and the dissolved state such as concentrated syrups. Crystalline fructose is composed of orthorhombic crystals which are white, odorless and hygroscopic; said crystals have a density of 1,590 kg/m$^3$ and a melting point of between 102 and 104° C., and are soluble in methanol, ethanol and isopropanol, and highly soluble in water. The fructose-rich syrups are concentrated aqueous solutions of fructose containing varying proportions of glucose, also known as dextrose, as well as, occasionally, small amounts of oligosaccharides. These syrups of fructose and glucose are usually obtained as a by-product produced in the processes for the manufacture of crystalline fructose of the prior art. Several fructose-rich syrups are utilized in the food industry; typically, their total dry solids concentrations range from 71% to 77% by weight, and their compositions in terms of fructose, glucose and oligosaccharides given, respectively, in percent by weight on a dry solids basis, comprise the following sets of values: [42%, 52%, and 6%]; [55%, 41% and 4%]; [80%, 18%, and 2%]; [90%, 8%, and 2%]; and [95%, 4%, and 1%]. In certain specific situations related to food and beverage products, there are employed crystalline fructose syrups.

It should be noted that, according to the technical publications The United States Pharmacopeia (1990) and Food Chemicals Codex (1992), fructose is defined as containing not less than 98% fructose, and not more than 0.5% glucose (both percentages by weight on a dry solids basis). This definition, used herein as well, is met only by crystalline fructose and crystalline fructose syrup.

The major industrial applications for fructose as an ingredient for food products, in the anhydrous crystalline form or in the dissolved state such as concentrated syrups, include baked goods and confections (cakes, cookies and sweets), breakfast cereals, nutritional candy bars, dairy products (ice cream, yogurt and chocolate milk), carbonated and noncarbonated beverages, powdered regular and diet beverages, meal supplements, condiments (catsup and sauces), preserves, jams and jellies.

Almost all of the processes for producing fructose that have been patented since the beginning of the 1960s use corn starch as raw material. In general, these industrial processes of the prior art share a common technological core that can be described briefly as follows. The first step of a typical process consists in the enzymatic hydrolysis of the corn starch, which produces a syrup containing about 94% (dsb) of glucose and about 6% (dsb) of oligosaccharides (As used hereinafter, "dsb" shall mean "by weight on a dry solids basis".). A portion of the glucose is then converted to fructose by means of a catalytic isomerization carried out by the glucose isomerase enzyme, thereby yielding a syrup which contains, typically, 42% (dsb) of fructose, 52% (dsb) of unconverted glucose and about 6% (dsb) of oligosaccharides. This syrup is then refined for the removal of color and ash, and enriched by means of one of two different commercial methods currently available for the large-scale purification of fructose, which are usually carried out in packed beds formed by cation-exchange resins; one of these methods employs an inorganic resin while the other one employs organic resins (U.S. Pat. No. 5,350,456; U.S. Pat. No. 5,656,094; Patent EP 0 613 954 A1). Normally, the said enrichment is achieved in a chromatographic column packed with a bed of an organic cation-exchange resin, which separates fructose from the glucose and other undesirable isomerization products (T. Hirota, "Continuous Chromatographic Separation of Fructose/Glucose", Sugar Azucar, 245–247, 1980; K. Venkatasubramanian, "Integration of Large Scale Production and Purification of Biomolecules", Enzyme Engineering, 6:37-43, 1982). At the end of this step there is obtained a fructose-rich syrup, referred to as Very Enriched Fructose Corn Syrup (VEFCS), which contains approximately 90% (dsb) of fructose. This VEFCS fraction, which also contains glucose and some oligosaccharides, is used as the feed for a final separation and purification step which consists in the crystallization of the fructose from aqueous solutions or from aqueous alcoholic solutions. Upon completing the centrifugation, the washing and the drying of the crystals, the anhydrous crystalline fructose is finally obtained (U.S. Pat. Nos. 3,513,023; 3,607,392; 3,883,365; 4,199,373; 4,199,374; 4,724,006; 5,047,088; 5,350,456; 5,656,094).

It is worth noting that in the cases where, in addition to the manufacture of the crystalline fructose, one of the commercial objectives consists in providing a liquid-phase sweetener to be employed in the preparation of food and beverage products, the refined syrup resulting from the isomerization step and having a fructose concentration of 42% (dsb) is evaporated to a dry solids concentration of 71% by weight, before being put into storage tanks. Another option for the industrial use of high-fructose syrups is represented by blending this 42% (dsb) fructose-rich syrup with the 90% (dsb) fructose-rich syrup produced at the end of the chromatographic fractionation step, thereby yielding a high-fructose syrup containing 55% (dsb) of fructose and having a dry solids content of 77% by weight, said syrup being used extensively as a liquid-phase sweetener in the food industry, especially in the carbonated beverage industry.

It should be noted that the production-of crystalline fructose by crystallizing the fructose from high-fructose syrups is generally carried out by one of the three following methods: crystallization from an aqueous solution; crystallization from an aqueous alcoholic solution; and drying of a fructose-rich syrup (U.S. Pat. Nos. 5,047,088; 5,350,456; 5,656,094; Patent EP 0 613 954 A1).

The first of these manufacturing processes consists in crystallizing the fructose from its concentrated aqueous solutions—or fructose-rich syrups—by employing adequate combinations and adjustments of the process variables, such as concentration, temperature, pressure and pH, and by adding to the solution small crystals of pure fructose which act as crystallization seeds, followed by a controlled cooling of the solution to approximately 25° C. in order to allow for crystal growth. This cooling must be accomplished carefully so as to avoid excessively high supersaturation levels which may cause the phenomenon of spontaneous nucleation to occur; said spontaneous nucleation phenomenon consists in a sudden and intense formation of minute crystals which may act as undesirable nuclei for the growth of crystals, thus favoring the production of a crystalline product which is constituted of small particles that exhibit a broad size distribution, being, therefore, a phenomenon harmful to the quality of the final product.

Owing to the extremely high viscosities of the saturated solution of fructose, which become even higher as the solution temperature is reduced, the periods of time required for accomplishing this type of crystallization are very long; often, these crystallization times attain values much longer than 50 hours, and may reach 70 hours or even more. Another problem which is inherent in the crystallization of fructose from an aqueous solution is represented by the low yields of crystalline fructose, which are usually lower than 40%, due to the high solubility of fructose in water, even at the lowest temperature attained in the final step of the crystallization process, which, as noted above, is approximately 25° C. (at this temperature, the solubility of fructose in water is 4 grams of fructose/gram of water) (U.S. Pat. Nos. 3,513,023; 3,883,365; 3,928,062; 4,199,373; 5,047,088; 5,350,456; 5,656,094; Patent EP 0 613 954 A1).

The second process for the crystallization of fructose comprises: introducing rapidly to a concentrated aqueous fructose solution an organic solvent—normally, an alcohol selected from the group consisting of methanol, ethanol and isopropanol; adding to the resultant aqueous alcoholic solution a seed made up of pure anhydrous fructose crystals; and, employing a vigorous agitation, accomplishing a controlled cooling of the said solution, thereby forming the fructose crystals. The patented processes employ, typically, aqueous syrups having a dry solids content of about 95% by weight, and a fructose content higher than 90% (dsb), preferably comprised between 93% and 96% (dsb) fructose (U.S. Pat. Nos. 4,199,374; 4,643,773; 4,724,006).

The alcohol which is added to the fructose-rich syrup, usually at a weight ratio of the fructose to the alcohol preferably comprised between 0.5 and 3, is utilized to effectively disassociate the fructose from the water, inasmuch as the methanol, the ethanol and the isopropanol have a higher degree of affinity for the water than does the fructose, thereby facilitating the crystallization of the fructose.

Another purpose of utilizing the aforesaid alcohols is the substantial reduction in the effective viscosity of the fructose-rich syrup achieved after the formation of the aqueous alcoholic solution, which contributes to the improvement of the agitation and mixing of the massecuite and to the enhancement of the crystal growth rates. The reduction in both the ability of fructose to stay in the aqueous solution and the effective viscosity of the mother liquor, caused by the alcohol addition, gives rise to shorter crystallization times—in the range of 12 to 24 hours—as well as to higher crystalline fructose yields, when compared with the respective typical values obtained in the process for the crystallization of fructose from aqueous solutions. However, large amounts of alcohol are required, so that the costs involved in the utilization of this type of solvent must be taken into account.

Besides this disadvantage of economic character, the method for crystallization of fructose from aqueous alcoholic solutions, as is well established in the prior art, has a strong tendency to undergo the undesirable phenomenon of spontaneous nucleation, due to the very rapid addition of a large amount of alcohol, before the introduction of the seed. This propensity for spontaneous nucleation is certainly an inherent weakness in this crystallization process.

The third method for the preparation of crystalline fructose consists in drying a very enriched fructose syrup in a rotary dryer, thereby producing a granular solid fructose which is comprised of a crystalline fructose portion and an amorphous fructose portion. Because the amorphous fructose is extremely hygroscopic, the handling of this semi-crystalline product in humid environments becomes rather difficult (U.S. Pat. No. 4,517,021).

All of the patented processes for the production of crystalline fructose combine various complex processing steps which give rise to a number of technical difficulties that usually lead to a decrease in the process efficiency and productivity, thus contributing to a costly manufacture of the crystalline fructose which, in turn, exhibits a performance below a desired optimum level in specific applications in the food industry and in the ultimate consumption as a powdered sweetener, as well as in handling, packing and storage.

The aforementioned processes of the prior art for the manufacture of crystalline fructose use almost exclusively corn starch as a basic raw material. The manufacturing steps of these processes, which comprise, typically, the extraction of starch from the corn, the enzymatic hydrolysis of this starch to form the glucose, the enzymatic isomerization of glucose to fructose, the chromatographic separation of fructose from the glucose and other isomerization products to yield an aqueous concentrated solution of fructose, the crystallization of fructose, and the separation, the washing and drying of the fructose crystals, involve a large number of chemical, physicochemical and physical processes and unit operations which have to be carried out within narrow ranges of process parameters such as flow rate, concentration, temperature, pressure and pH, in order to achieve their objectives (L. M. Hanover and J. S. White, "Manufacturing, Composition, and Applications of Fructose", Am. J. Clin. Nutr., 58(suppl.), 724S–732S, 1993; U.S. Pat. Nos. 3,883,365; 4,199,373; 4,724,006; 5,047,088; 5,350,456; 5,656,094; Patent EP 0 613 954 A1). These aspects require the use of theoretical and practical knowledge having a high scientific and technical content, in addition to the accurate design, operation, control and optimization of these industrial processes.

Among the constituent steps of a typical process of the prior art, which were listed above, the crystallization step represents the most important technical constraint. In the systems which contain the chemical compound of interest dissolved in a solution, the driving force for the formation (or nucleation) and the growth of the respective crystals is the supersaturation of this compound at existing conditions of temperature, pressure, and composition of the solution. For a given set of values of these thermodynamic parameters, supersaturation is defined as the difference between the concentration of the compound in the solution (C) and its saturation concentration ($C_{sat}$) which, in turn, is the maximum concentration of solute which is thermodynamically stable in solution. This driving force, $C–C_{sat}$, must not be excessive throughout the crystallization process, in order to be avoided the occurrence of a labile supersaturation region which exhibits a high thermodynamic instability and where nuclei are formed spontaneously and intensely from a clear solution (spontaneous nucleation phenomenon); said nuclei usually harm the purity, the morphology and the granulometric distribution of the fructose crystals in the finished product, as well as the process yield. Therefore, in order that the spontaneous nucleation be suppressed, supersaturation must be maintained at sufficiently reduced levels so that solute in excess of the equilibrium concentration will deposit on existing crystals but no new crystal nuclei are formed (metastable region), throughout the crystallization step, to allow the formation of crystals of high purity and with morphological and granulometric characteristics which are adequate for the desired industrial applications.

The crystallization of fructose from aqueous solutions is a process of difficult execution largely due to the very high solubility of fructose in water and also because it involves phase equilibria in a considerably complex system, which consists of at least three components—fructose, glucose and water. When the crystallization is accomplished from aqueous alcoholic solutions, the problem represented by the high solubility of fructose in water is essentially solved by means of a substantial removal of the water from the fructose molecules owing to the presence of the alcohol; however, the addition of another component—the alcohol—renders the system phase equilibria even more complex, which results in more technical difficulties for achieving the accurate control of the supersaturation level of the fructose syrup along its cooling curve whose path is made up of a series of points located under the corresponding saturation temperatures of the fructose syrup, for the particular system conditions. Since supersaturation is defined as the difference between the quantity of fructose effectively dissolved in the syrup and its solubility in this syrup, for the same set of particular conditions, the knowledge of the fructose solubility as a function of temperature and composition of the crystallization medium is of fundamental importance for the optimization of the process-operating points of seeding the syrup, of addition of alcohol and of termination of the crystallization process. It must be stressed that, during the development of the present invention, this information of a scientific and technological nature was determined experimentally for the ternary (fructose-glucose-water) and quaternary (fructose-glucose-water-ethanol) systems employed in the crystallization process, what allowed the optimization of this processing method and its results, in terms of both the excellent physical and functional characteristics of the crystalline product obtained and the high yield of the process according to the invention.

Considering several other factors related to the processes of the prior art, it becomes evident that the crystallization of fructose from aqueous or aqueous alcoholic media is highly complex inasmuch as it involves many process variables and requires stringent conditions for the operation of the system, such as: high solids concentration in the fructose-rich syrup used as the feed for the crystallizer (normally, higher than 90% by weight dry solids); high fructose purity of this crystallizer feed syrup (higher than 90% (dsb) fructose, preferably between 93 and 96% (dsb)); very high solubility of fructose in water; extremely high effective viscosities of the aqueous massecuite; narrow operating ranges for the pH of the solution; characteristics of the alcohol addition (temperature and rate of addition, and fructose-to-alcohol ratio); granulometric characteristics of the seed; characteristics of the seed addition (temperature and rate of addition, and proportion between the mass of fructose seed crystals and the mass of fructose in the syrup); accurate control of temperature during the additions of the alcohol and the seed, so as to eliminate or minimize spontaneous nucleation; and establishment of a precise degree of supersaturation of the fructose solution through an accurate control of its cooling. This formidable set of process variables and operating conditions makes the unit operation of crystallization a critical step in the method for the production of crystalline fructose and introduces a greater difficulty to the operation and control of the respective manufacturing processes, as well as a greater degree of uncertainty in the increase or in the decrease in production scales.

In addition to the problems described above, the use of virtually a single source of raw material—corn starch—by nearly all the processes of the prior art constitutes a strategic vulnerability as regards the production of fructose, due to the potential occurrence of factors which adversely affect the regular supply of corn, such as substantial reductions in crops as a result of prolonged droughts, floods or pests, as well as to sharp rises in the price of corn caused by strong seasonal fluctuations in its demand. Another limiting aspect is represented by the use of essentially the same technological route by all the processes of the prior art for the manufacture of fructose, what constitutes a weakness of the technical field of the invention due to the virtual non-existence of feasible and economically viable technological alternatives.

The present invention overcomes these deficiencies by providing a distinct and superior technology, when compared with those of the prior art, which combines a radically different source of raw material—sugar cane sucrose—and an original and economical processing route. These features, essential to the present invention, constitute an "upstream" novelty, that is, an innovation introduced into the origin of the process and, consequently, into the fundamental elements of the corresponding process for producing anhydrous crystalline fructose, with respect to the prior art. Thus, the invention established by the Applicant represents an important industrial alternative of a strategic, technological and commercial nature.

As regards the details of the process for the production of crystalline fructose, the present invention is markedly differentiated from the processes of the prior art, possessing a high degree of inventiveness. Such inventiveness is revealed through several technical improvements and innovations, which combine to form a processing route which is simpler and more efficacious when it is compared with the patented technologies, and which route consists of a first step, of an essentially chemical character, wherein the fructose is formed by means of the acid hydrolysis of sucrose; a second step, of a physical and physicochemical character, wherein the fructose is separated from the glucose in a chromatographic column and the fructose solution is subsequently concentrated by evaporation of water until it becomes an aqueous fructose-rich syrup; and a third step, of a physicochemical character, wherein the crystallization of fructose is carried out by the controlled cooling of its aqueous alcoholic syrup, formed in one of the five constituent stages of the crystallization process, followed by the centrifugation, the washing and the drying of the fructose crystals thus obtained.

The anhydrous crystalline fructose produced by the process according to the invention has a high degree of purity, which is quantified by a fructose content much higher than 98% (dsb), and a glucose content lower than 0.5% (dsb); these values have been specified by the technical publications The United States Pharmacopeia (1990) and Food Chemicals Codex (1992) as being the limits that define the crystalline fructose, as mentioned previously.

The excellent purity of the fructose crystals, their well defined shapes which are typical of the orthorhombic crystal system, and the considerable uniformity of their sizes, which are features resulting from the innovations introduced into the original and improved crystallization process in accordance with the invention, reveal a very good stability of the crystalline product, which in turn is manifested by a reduced hygroscopicity. Moreover, owing to the very high fructose content and the morphological integrity of the crystals produced by the process according to the invention, the particulate product exhibits a low friability which permits that the good fluidity of the particulate material be maintained during its handling, packing, storage and ultimate consumption as a powdered sweetener. In addition, its microcrystalline granules exhibit a narrow particle size distribution with a mean diameter comprised between about 250 microns and about 350 microns, thereby permitting a good fluidity of the powder and the achievement of short dissolution times of its constituent particles.

The manufacture of anhydrous crystalline fructose from sugar cane sucrose, having a high chemical purity and properties perfectly adjusted so as to satisfy the stringent requirements of the food industry, is now possible due to the technical novelties and improvements incorporated into the manufacturing process developed by the Applicant.

The objects of the present invention are: a) the process for the production of crystalline fructose of high purity utilizing fructose syrup having a low content of fructose made from sucrose; and b) the crystalline fructose obtained by said process.

The main idea which guided the establishment of the invention consisted in developing an original and commercially viable technological route which would use a raw material other than corn starch and that would be consistently, or historically cheaper than this feedstock in the brazilian market, would have, on a large scale, a regular availability, and would be highly reliable with respect to its supply besides having an adequate quality in order to be employed as an industrial feedstock. Additionally, in its corresponding processing scheme there should not be a step of enzymatic isomerization of glucose to fructose, because such a step, which forms an integral part of the typical processes of the prior art, besides exhibiting a relatively low level of conversion of glucose to fructose effected by the glucose isomerase enzyme immobilized on a fixed bed in a column, is considerably complex and costly, exhibiting several difficulties. For example, the immobilized glucose isomerase has an enzyme activity which decays exponentially as the time increases, during its usage, thereby requiring the employment of successively lower flow rates of the glucose stream fed into the column so as to provide longer residence times to compensate for the decrease in the enzyme activity and maintain an adequate conversion level. This aspect harms the productivity of the aforesaid typical processes of the prior art, requiring that multiple immobilized isomerase columns be operated in parallel in order that the desired production level be maintained. Furthermore, the isomerization reaction promoted by the glucose isomerase generates a certain amount of acidic glucose decomposition products, which are formed as a result of the specified temperature and pH, and produces color and some ash from the chemicals added for isomerization; the removal of these impurities gives rise to additional operations and their associated costs. Another difficulty intrinsic to this enzymatic isomerization step, which is common to all processes that employ immobilized enzymes, is represented by the need to replace the enzyme when it is exhausted (L. M. Hanover and J. S. White, "Manufacturing, Composition, and Applications of Fructose", Am. J. Clin. Nutr., 58(suppl.), 724S-732S, 1993; U.S. Pat. Nos. 5,350,456; 5,656,094; Patent EP 0 613 954 A1).

Another aspect inherent in the typical processes of the prior art for the manufacture of fructose which is problematic, and therefore should be noted, consists in also utilizing an enzymatic route for the carrying out of the corn starch hydrolysis. Normally, this hydrolysis is accomplished in two stages, one of which employs the α-amylase, and the other one employs the glucoamylase. When compared with the hydrolysis accomplished by a purely chemical route, the enzymatic hydrolysis exhibits, generally, greater technical difficulties inasmuch as the enzymes are sensitive, labile entities, which require a great care during their utilization in order to maintain their catalytic activity at adequate levels. Furthermore, they are usually expensive and need to be removed from the product after achieving the desired conversion, when used in a solution, or replaced after having their catalytic activity exhausted, when immobilized or adsorbed onto a support (M. B. Hocking, Handbook of Chemical Technology and Pollution Control, Academic Press, San Diego, 1998, p. 545; U.S. Pat. Nos. 5,350,456; 5,656,094; Patent EP 0 613 954 A1).

The studies conducted by the Applicant revealed, unequivocally, that the raw material which combines, advantageously, the strategic and commercial features mentioned above and permits the establishment of a technological route which is relatively simple, efficient and productive, thereby meeting the criteria specified in the inventive concept, is the sucrose obtained from the sugar cane. It is important to emphasize that, in Brazil, the sucrose from sugar cane is a feedstock which is available on a large scale and it is not subject to seasonal fluctuations in its demand, being supplied regularly with a good product quality by a great number of producers and, furthermore, it has been historically cheaper than starchy feedstocks. These characteristics reinforce the perfect adequacy of the sucrose to serve as an excellent raw material for the process according to the invention.

BRIEF DESCRIPTION OF THE DRAWING

The process for the production of crystalline fructose of high purity utilizing fructose syrup having a low content of fructose made from sucrose, said process comprising an object of the present invention, is described below in detail and shown schematically in FIG. 1.

The process according to the invention comprises three steps. The first of these consists in the chemical conversion of sucrose to fructose and glucose by means of an acid hydrolysis. Initially, the crystallized sucrose having a minimal purity of 99.5% (dsb) is dissolved in water, thereby producing a solution having a concentration of 60% by weight, and is then subjected to an enzymatic treatment in order to eliminate any residual starch. Afterward, this sucrose undergoes a hydrolysis reaction catalyzed by hydrochloric acid, or other inorganic acid, yielding a solution of fructose and glucose having a dry solids concentration of 60% by weight. After the completion of the acid hydrolysis, the solution obtained is neutralized and purified by deionization in an ion exchange unit, which removes certain kinds of anions and cations that could contaminate, in the subsequent step, the resin which constitutes the packing material of a chromatographic separation column, which forms an integral part of the process, what would cause a significant decrease in the performance of the column operation.

Figure 1:
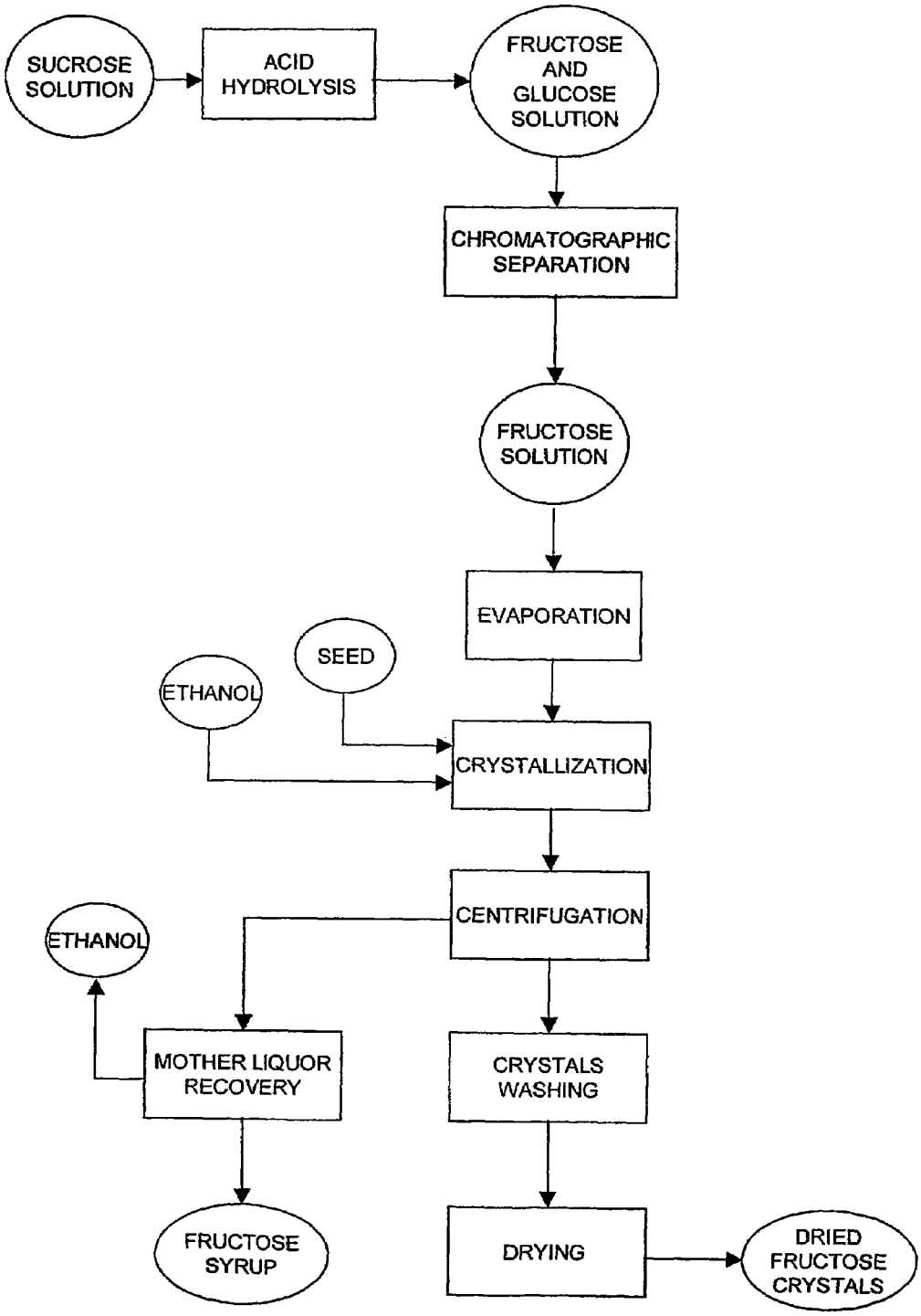

The second step of the process according to the invention consists of the partial separation of fructose from the glucose and the preparation of a fructose-rich syrup which also contains small quantities of glucose. The aqueous solution of fructose and glucose having a dry solids concentration comprised between 58% and 59% by weight obtained in the previous step, just after the deionization operation, and at a temperature comprised between 58° C. and 62° C., is fed into a chromatographic column containing a packed bed formed by cation-exchange resins that adsorb fructose to a greater degree than glucose. As a consequence of this selective retention of fructose by the resin, a partial fractionation of these two isomers is obtained. Thereafter, elution water, which has been deoxygenated and deionized in a special ion exchange unit, is introduced into the chromatographic column to effect the desorption of fructose, thereby obtaining a solution of fructose and glucose having a dry solids concentration comprised between 22% and 26% by weight, preferably comprised between 23% and 25% by weight, and having a fructose content comprised between 84% and 90% (dsb), preferably comprised between 86% and 88% (dsb), which is then evaporated under vacuum to a dry solids concentration comprised between 79% and 81% by weight, at a temperature comprised between 59° C. and 61° C. After this step, at a temperature comprised between 59° C. and 61° C., such a solution is subjected to carbon treatment accomplished with granular carbon to remove color, and is then concentrated by evaporation under vacuum to form an aqueous syrup of fructose and glucose having a dry solids concentration of greater than 92% by weight, preferably comprised between 93% and 95% by weight, at a temperature of between 59° C. and 61° C., and wherein the fructose content is comprised between 84% and 90% (dsb), preferably comprised between 86% and 88% (dsb), and the glucose content is comprised between 9% and 15% (dsb), preferably between 11% and 13% (dsb); the syrup thus obtained constitutes the feed stream for the final process step.

It should be noted that the aforesaid contents of fructose in the feed syrup for the crystallization stage, which are sufficient for achieving high yields of a crystalline product with excellent physical and functional characteristics, in accordance with the present invention, are considerably lower than the corresponding fructose contents which are required by the technologies of the prior art and which are comprised, typically, between 90% and 96% (dsb), as mentioned previously. It is important to emphasize that the exceedingly low contents of fructose in the feed syrup for the crystallization process constitute an important novelty of the invention in relation to the prior art, and that the corresponding technical effects obtained are represented by a substantial reduction in the level of the technical difficulty associated with the requirement of being attained high values of fructose purity at the end of the chromatographic separation step, which requirement is intrinsic to all of the processes of the prior art, and by an appreciable reduction in the operating costs of the chromatographic separation of fructose, due to a lower fructose purity required for an optimum crystallization. The latter technical effect becomes especially important when contrasted with the processes of the prior art that achieve the separation of fructose from the glucose by means of an array, or group of chromatographic columns which operate in sequence in order to attain the aforementioned high values of fructose purity.

It should also be noted that the crystallization stage, which forms an integral part of the process according to the invention, can be accomplished with the same efficacy when employing fructose contents higher than its preferred range of values the process developed by the Applicant can utilize, advantageously and successfully as regards the manufacture of crystalline fructose, syrups having fructose contents higher than 90% (dsb).

The third step of the process according to the invention consists of the crystallization of fructose from an aqueous alcoholic medium, the recovery of the fructose crystals through the centrifugation of the massecuite, and the washing and drying of such crystals. The alcohol which has the best characteristics compatible with those required by this processing step, in accordance with the invention, is the ethanol because it is totally miscible with water besides being a food-grade alcohol.

The crystallization of fructose by the cooling of its syrup, in accordance with the invention, is carried out in five stages which include the controlled cooling of the solution, the addition of crystallization seeds and the addition of alcohol (absolute ethanol) to the syrup.

In the first stage, the fructose syrup that leaves the vacuum evaporation unit, having a dry solids concentration of greater than 92% by weight and a fructose content preferably comprised between 86% and 88% (dsb), is rapidly cooled from a temperature comprised between 59° C. and 61° C. to a temperature comprised between 52° C. and 58° C. The rapidity of such cooling is aimed at avoiding the thermal decomposition of the fructose that usually occurs when it is subjected to temperatures higher than 65° C. for relatively long periods of time; obviously, an undesirable occurrence of the thermal decomposition of fructose would decrease the crystallization process yield.

Subsequently, there is initiated the second stage wherein there is accomplished an isothermal seeding of the syrup, that is, at the same temperature as the temperature of the syrup that has been reached at the end of the preceding stage, with pure anhydrous fructose crystals having particle sizes comprised between about 40 microns and about 80 microns, for a period comprised between 2 and 4 hours, and having a weight of pure fructose seed in relation to the weight of fructose in the syrup comprised between 5% and 9% (dsb), preferably comprised between 6% and 8% (dsb). The utilization of the seed in the form of small particles and at a high weight ratio of seed to the fructose in the syrup is aimed at providing a large surface area for crystal growth by the mechanism of surface integration, which consists in the bind of the solute molecules to the faces of the crystals through a surface reaction, thereby allowing the crystals to become sufficiently large for their applications and to be more easily separated from the mother liquor during the centrifugation operation, at the end of the crystallization, what contributes to the attainment of the high yields of recovery of crystalline fructose which are typical of the process according to the invention. During the seeding proper, there is a slight growth of the seed crystals, so that at the end of this second stage there is obtained a massecuite consisting of, essentially, a mass of fructose crystals and an aqueous syrup of fructose and glucose, at the same temperature as the temperature employed at the end of the first stage.

The third stage consists in the slow cooling of the massecuite according to a predetermined and automatically controlled cooling curve through a critical temperature range wherein the optimal supersaturation level of fructose should not be exceeded so as to prevent any spontaneous nucleation. Therefore, the massecuite temperature is lowered continuously, at a constant rate of between 0.7° C./h and 0.9° C./h, until it stabilizes at a level wherein the temperature is comprised between about 54° C. and about 48° C. In the course of this stage, the seed crystals grow considerably, attaining sharp edges, flat faces and well defined shapes.

In the fourth stage, absolute ethanol at a temperature equal to that of the massecuite at the end of the third stage is added slowly and regularly to such a massecuite, for a period comprised between about 6 hours and about 10 hours, preferably between about 7 hours and about 9 hours, until a weight ratio of the ethanol to the water in the syrup comprised between 1.0 and 2.0 grams of ethanol per gram of water is reached. As a result, at the end of this fourth stage, which is carried out isothermally, there is obtained a substantial decrease in the solubility of the fructose in the crystallization medium, which now has become an aqueous alcoholic solution, simultaneously with a great reduction in the extremely high viscosity of the aqueous syrup; such viscosity reduction causes an increase in the effective diffusivity of the fructose in the solution and favors an improved agitation of the massecuite, whereby results an improved mass transfer from the solution to the surface of existing crystals, thus facilitating their growth. Moreover, the greater degree of mixing arising from the reduced effective viscosity of the aqueous alcoholic syrup leads to the homogenization of temperatures and concentrations in the bulk of the syrup, thus avoiding the establishment of excessive local supersaturations, which might give rise to an undesirable spontaneous nucleation, and enables the dispersion of the growing crystals evenly throughout the massecuite, thereby promoting the production of crystals having a narrow size distribution.

It is of interest to note that the crystallization seeds which are added to the syrup prior to the alcohol addition act as preferred sites for the precipitation of the fructose and the macroscopic crystal growth (method of formation of crystal nuclei called heterogeneous nucleation), thus preventing, due to their own presence in the solution during the alcohol addition, the generation of clusters of solute molecules in the bulk of the solution; such clusters may combine into embryos which in turn are responsible for the initiation of the spontaneous nucleation in the clear solution (homogeneous nucleation)(P. A. Belter, E. L. Cussler, and W. Hu, "Bioseparations: Downstream Processing for Biotechnology", John Wiley & Sons, New York, 1988, pp. 277–278). In fact, throughout the ethanol addition, according-to the original method developed in the present invention, the crystals suspended in the aqueous alcoholic solution grow with a minimal occurrence of any spontaneous nucleation. At the end of the isothermal addition of ethanol, the fructose crystals, which now have grown significantly, exhibit a considerably narrow granulometric distribution.

At this point, it should be noted that the problem of spontaneous nucleation was solved in an original way in the present invention, as described below.

In the processes of the prior art for crystallization of fructose from aqueous alcoholic solutions, the alcohol addition to the aqueous syrup of fructose is achieved rapidly, at high alcohol to fructose weight ratios, and before the addition of the crystallization seeds. Such processing conditions bring about a situation that is extremely favorable to the occurrence of a sudden, intense, and uncontrolled nucleation, which gives rise to a mass of relatively small crystals having a broad size distribution, what is incompatible with the desired final product. Such spontaneous nucleation results from an almost instantaneous occurrence of an excessive supersaturation level of the aqueous fructose solution in consequence of the removal of a large portion of the water from the fructose effected by the alcohol, which has been quickly added to the syrup, and also due to the substantial reduction in the effective viscosity of the aqueous alcoholic solution, what gives rise, suddenly, to a much more intense and effective agitation, thus favoring a flow-induced crystallization such as it occurs in some polymer solutions (G. Astarita, "Thermodynamics", Plenum Press, New York, 1989, p. 149). As it is well established, the crystallization of substances from supersaturated liquid solutions is a process which is affected by the flow field resulting from the agitation and mixing of the fluid; in fact, both macro-scale and micro-scale shear rates around the impeller usually influence the size and character of the crystalline solid produced (J. Y. Oldshue, "Fluid Mixing Technology", McGraw-Hill, New York, 1983, p. 239). As mentioned previously, another aspect which favors the occurrence of the spontaneous nucleation, under the aforesaid processing conditions, is represented by the non-existence of crystallization seeds in the aqueous solution, during the alcohol addition.

In contrast to what is established in the prior art, the Applicant has virtually eliminated the problems associated with the spontaneous nucleation by providing a solution which consists in the inversion of the aforementioned procedure, according to which there is accomplished a rapid addition of the alcohol prior to the introduction of the seed crystals. Namely, in accordance with the present invention, the alcohol is added to the aqueous syrup of fructose in a low alcohol to fructose weight ratio, very slowly, and only after the seeding. According to this new procedure, which is innovative in comparison with the prior art, there is established a gradual reduction in the solubility of fructose in the aqueous solvent, what permits to maintain a small and controlled degree of supersaturation of the solution in the metastable region and during the whole period of addition of the alcohol, thereby avoiding the labile region of supersaturation; furthermore, the reduction, gradual as well, of the viscosity of the aqueous alcoholic medium enables the agitation to become more effective progressively so as not to cause an abrupt increase in the level of the shear stresses in the fluid, thus preventing a sudden occurrence of a precipitation induced by the intensification of the flow, while permitting an efficacious mass transfer by means of the diffusion of the fructose molecules from the bulk of the solution to the surface of the crystals, thereby enabling a high rate of crystal growth. Finally, the seed which has been previously added to the syrup provides a preferred surface for crystallization.

These technical aspects comprise an important novelty of the invention, their corresponding technical effects being the suppression or reduction of the spontaneous nucleation and the production of crystals having morphological and granulometric characteristics very well adjusted for the desired applications.

The fifth stage of the process for the crystallization of fructose consists in accomplishing a slow cooling of the aqueous alcoholic massecuite obtained at the end of the previous stage, according to a predetermined and automatically controlled cooling curve, from its temperature at that point, comprised between about 54° C. and about 48° C., to a temperature comprised between about 30° C. and about 25° C., at a constant cooling rate of between 0.4° C./h and 0.8° C./h. Throughout this stage of slow lowering of the temperature, wherein spontaneous nucleation does not occur, the crystals grow substantially, achieving sizes which are sufficiently large for their applications, as well as sharp edges, flat faces and well defined shapes which are typical of the orthorhombic crystal system. The crystallization is completed immediately after an additional period which serves to stabilize the temperature reached by the massecuite at the end of this final stage, comprised between 30° C. and 25° C.; such final temperature of the crystallization process is also equal to the temperature of the centrifugation of the crystals, which is carried out shortly thereafter.

It is of interest to note that the overall crystallization process according to the invention is accomplished between about 40 hours and about 50 hours, which is a total crystallization time comprised between those of crystallization of fructose from aqueous alcoholic solutions and from aqueous solutions, respectively, which are obtained in the processes of the prior art.

The recovery of the fructose crystals is carried out by means of centrifugation of the aqueous alcoholic massecuite, which produces a cake consisting of fructose crystals and a saturated aqueous alcoholic syrup of fructose; the latter, being a crystallization mother liquor having some residual alcohol, is called aqueous alcoholic mother liquor. The separation of the crystals from the liquor by means of centrifugation is facilitated due to the relatively low effective viscosity of this aqueous alcoholic mother liquor, thereby minimizing the fructose losses and contributing to the achievement of the high process yield. Afterward, the crystals are washed with cold ethanol at a temperature of 4° C., in the centrifuge, to remove any glucose adhered to the surface of the crystals, thereby increasing even further the already high purity of the crystalline fructose. The washed crystals are then transferred to a rotary dryer that employs dry air at a temperature of at most 80° C., and that accomplishes the drying of crystals which are fed with a moisture content of about 3%. The adequately dried crystals, having moisture levels less than 0.1%, are sized by screening and packed in an environment with controlled temperature and humidity, and are then stored for subsequent commercialization.

A quantity of fructose crystals of approximately 10% of the entire mass is separated for the preparation of seed for a further production cycle. In the preparation of this seed, the crystals are ground until they attain sizes preferably comprised between about 40 microns and about 80 microns, after which they are screened. The utilization of part of the crystalline fructose produced by the process as crystallization seeds in a subsequent cycle for the manufacture of the fructose represents an essential and advantageous characteristic of the process according to the invention.

At this juncture, it is important to point out several technical and economic considerations related to the third step of the process as well as to describe the main advantages and technical effects accomplished by the invention, resulting from the corresponding inventiveness achieved by the Applicant.

In order that the process be more economical, the alcohol used in the crystallization and in the washing of the crystals is recovered to be reused in the process, and the aqueous alcoholic mother liquor, saturated with respect to fructose, is recovered to produce an economically valued by-product.

The crystallization aqueous alcoholic mother liquor obtained after the completion of the centrifugation of the massecuite is admixed with the alcohol used in the washing of the crystals, is diluted with water and is then evaporated under vacuum until the complete removal of the ethanol is achieved. After this evaporation, the aqueous alcoholic solution is subjected to a distillation, giving rise to a concentrated alcohol stream and a stillage stream. In a subsequent production cycle, carried out in the equipment proper or in a second crystallizer connected in series to the first one, the concentrated alcohol is recycled to be used in the stage of alcohol addition in the crystallization process and in the washing of the crystals during the second phase of centrifugation, while the stillage is recycled to the dilution of the mother liquor during the alcohol recovery step.

The mother liquor subjected to evaporation, and without any alcohol, is actually an aqueous fructose-rich syrup having a dry solids concentration of from about 60% to 70% by weight, a fructose content comprised between 74% and 80% (dsb) and a glucose content comprised between 18% and 24% (dsb), and which syrup constitutes a valuable by-product that can be employed as a liquid-phase sweetener, in which case it is sold as a fructose-rich syrup, or as an industrial feedstock for a type of application wherein it undergoes a hydrogenation to obtain mannitol and sorbitol.

In effect, the reuse of the process alcohol and the wash-alcohol in a subsequent production cycle and the recovery of the aqueous alcoholic mother liquor to produce a valuable by-product constitute essential and very advantageous characteristics of the invention, inasmuch as they increase the process profitability and contribute to the waste minimization.

Another essential and advantageous characteristic of the process for crystallization of fructose according to the invention is represented by the employment of fructose to alcohol weight ratios comprised between about 5 and about 10, preferably comprised between about 6 and about 8, which are much higher than those employed in the processes of the prior art, which are typically in the range of 0.5 to 3. This characteristic reveals that the process for the crystallization of fructose from an aqueous alcoholic solution, in accordance with the invention, consumes significantly lesser quantities of alcohol than the analogous processes of the prior art, being, in this respect, more economical than these.

It should also be pointed out that the reduced effective viscosity of the aqueous alcoholic syrup, obtained at the end of the stage of alcohol addition to the aqueous syrup, promotes a considerable decrease in the power required for mixing the massecuite during the final stage of the process, thereby reducing the associated operating costs.

Finally, it is worth noting that the crystallization step, according to the invention, gives yields of recovery of crystalline fructose, based on the weight of fructose contained in the feed syrup, comprised between about 40% and about 60%; these yields demonstrate the effectiveness of this novel technology.

The purity of the fructose crystals produced by the process according to the invention is excellent, being manifested by a content of fructose higher than 99.50% (dsb) and a content of glucose (which is virtually the sole residual impurity in this crystalline product) of less than 0.50% (dsb). Furthermore, these microcrystalline particles exhibit a considerably narrow granulometric distribution with a mean diameter comprised between about 250 microns and about 350 microns, and have a residual moisture content, as measured by the Karl Fischer method, lower than 0.1% by weight.

In spite of the large number of technical difficulties intrinsic to the process for crystallization of fructose, widely acknowledged in the scientific and technological literature, and particularly through the body of knowledge contained in the patents pertaining to the technical field of the invention, the aforementioned crystallization process turned out to be, surprisingly, an advantageous source of important technical novelties and improvements introduced by the Applicant.

The simultaneous association of these technical novelties and improvements established in the process for crystallization of fructose from aqueous alcoholic medium, according to the invention, produces the following technical effects: a very high purity and excellent morphological and granulometric characteristics of the anhydrous fructose crystals; the suppression or reduction of the occurrence of spontaneous nucleation; a low alcohol consumption; a relatively short period for the crystallization cycle; a high yield of fructose recovery; and an improved economics of the crystallization process, thereby rendering the process for the production of fructose more profitable. Overall, these technical results accomplished in the crystallization step reveal a substantial degree of inventiveness achieved by the Applicant and contribute significantly to the innovative content of the present invention.

The several different aspects regarding the physical and functional characteristics of the crystalline fructose of high purity produced by the process according to the invention are discussed in detail below.

The technical specifications of the final product obtained, particularly its chemical purity, associated with the nature of the raw material used and the type of processing employed, as well as its granulometric spectrum, meet all international standards for food-grade crystalline fructose.

A particle-size analysis performed on the particles which constitute the crystalline fructose obtained according to the invention reveals that this particulate material has a narrow and centered particle size distribution with a mean diameter comprised, preferably, between about 250 microns and about 350 microns, and possesses approximately 70% of its particles with sizes within this range. The aforementioned granulometric characterization of the crystalline fructose is complemented by the following results, which express the relative percentage by weight of particles of each of the different size fractions represented in a given sample: 1% over 595 microns; 15% over 425 microns; 70% over 250 microns; 12% over 180 microns; and 2% between 100 microns and 150 microns.

Another essential physical characteristic of the crystalline fructose of high purity according to the invention, for a particle size cut within the range of about 100 microns and about 595 microns, is the apparent density, comprised between about 0.50 g/l and about 0.56 g/l, preferably comprised between about 0.51 g/l and about 0.55 g/l and more preferentially comprised between about 0.52 g/l and about 0.54 g/l.

The principal functional characteristics which reveal the performance of the anhydrous crystalline fructose obtained by the process according to the invention in its industrial applications are the hygroscopicity and the dissolution time, which are described below.

The first essential functional characteristic of the crystalline fructose of high purity manufactured by the process according to the invention is the hygroscopicity, which relates to the tendency that its crystals have to absorb moisture from the air, due to the strong affinity of fructose for the water vapor. It may be noted that a considerably high hygroscopicity is very harmful to the fluidity because the moisture absorbed agglutinates the powder, thereby hindering the free flow of its particles. Hygroscopicity is defined as the proportion by weight represented by the water absorbed by a sample of the particulate product which is kept in a hygrostat at a constant relative humidity of 80%, for 24 hours. Subjected to this test, the crystalline fructose according to the invention exhibits a hygroscopicity which is less than about 3%, preferably less than about 2.9% and, still more preferably, less than about 2.8%. These values reveal that the said crystalline fructose has a relatively low hygroscopicity, which results from its high physicochemical stability which, in turn, stems from the very high purity and the well defined morphology (similar to the orthorhombic crystal system, which is characteristic of the fructose) conferred on its crystals by the processing. The reduced hygroscopicity of the said crystalline fructose constitutes a significant technical effect accomplished through the inventiveness achieved by the Applicant, thereby permitting, advantageously, a better handling, packing, storage, transportation and final consumption, since the agglutination of the powder is minimized, and therefore there is maintained its good fluidity for longer periods of time, thus hindering the occurrence of any subsequent caking.

The other essential functional characteristic of the crystalline fructose according to the invention is represented by the dissolution time, expressed in seconds, which reveals the higher or lower ability that a given amount of the particulate material has to dissolve completely in a predetermined amount of water, under specific conditions of temperature and agitation, in order to form a perfectly clear or transparent solution. The dissolution time is measured by means of a specific test which consists in introducing 5 grams of a granulometric cut, within the range of 100 microns to 595 microns, of the product to be tested into 150 g of demineralized and degassed water maintained at 20° C. and subjected to stirring at 200 rpm in a 250 ml low form beaker, the dissolution time being the time necessary, after introduction of the granulometric cut, to obtain perfect visual clarity of the suspension thus prepared. Under these conditions, the crystalline fructose according to the invention exhibits a dissolution time which is less than 15 seconds, more preferably less than 12 seconds. These values demonstrate that the product according to the invention dissolves very quickly in water, not only due to the very high solubility of fructose in water, but also due in large measure to its distinct granulometric spectrum, which is strongly favorable for the dissolution of its microcrystalline granules. The good ability of the crystalline fructose to dissolve, thereby permitting its use in numerous applications in the food industry and as a nutritive powdered sweetener, is an essential and advantageous characteristic of the invention.

In summary, the present invention, by innovating the raw material and the technological route for the production of anhydrous crystalline fructose, constitutes an industrial alternative which renders it possible to obtain a combination of strategic, technical, economic, and commercial factors which is distinctly different from and much better than those employed by the prior art. In addition, the technical novelties and improvements incorporated into the process according to the invention give rise to important technical effects, which comprise the reduction in the degree of technical difficulty and in the costs of the chromatographic separation of fructose; the suppression or reduction of spontaneous nucleation and the low alcohol consumption in the crystallization process; the moderate crystallization times; the high yields of crystalline fructose recovery; the improved economics of the crystallization process; the production of a valuable by-product, represented by an aqueous fructose-rich syrup; and the production of fructose crystals of high purity, having morphological, granulometric and functional characteristics adequate for the desired applications.

The raw material consisting of the sucrose, the original processing route and the extensive set of technical effects accomplished reveal the high innovative content of the invention, and therefore its inventiveness. Consequently, the process for the production of crystalline fructose of high purity in accordance with the present invention constitutes an industrial technology which is distinct and superior when compared with the analogous methods of the prior art.

For the purpose of providing a better understanding of the invention, the following preparation example will serve to illustrate the invention without limiting the scope thereof.

EXAMPLE

Preparation of a Crystalline Fructose of High Purity in Accordance With the Invention.

An aqueous solution of sucrose having a purity of 99.7% (dsb) and a concentration of 60% by weight was subjected to an enzymatic treatment to remove the residual starch; afterward, this sucrose in solution underwent a hydrolysis reaction catalyzed by hydrochloric acid contained in an aqueous solution, thereby having been produced a solution of fructose and glucose having a dry solids concentration of 60% by weight. After the acid hydrolysis, the said solution of fructose and glucose was neutralized and deionized, having attained a dry solids concentration of 58% by weight and a temperature of 59° C., and was then fed into a chromatographic column. After the completion of the separation, deoxygenated and deionized elution water was introduced into the chromatographic column, thereby having effected the desorption of fructose; as a result, there was obtained a solution of fructose and glucose having a dry solids concentration of 24% by weight and a fructose content of 87% (dsb), which was then evaporated under vacuum to a dry solids concentration of 80% by weight, at a temperature of 60° C. At this temperature of 60° C., this solution was subjected to carbon treatment to remove color and was then concentrated by evaporation under vacuum, thereby producing an aqueous syrup of fructose and glucose, at the same temperature of 60° C., having a dry solids concentration of 93% by weight, a fructose content of 87% (dsb) and a glucose content of 12% (dsb); the syrup thus obtained constituted the feed stream for the final process step, which consisted in the crystallization of fructose, carried out in five stages.

In the first stage of crystallization, the aforesaid fructose syrup, having a dry solids concentration of 93% by weight and a fructose content of 87% (dsb), was rapidly cooled from 60° C. to 55° C.

Thereafter, there was initiated the second stage of the crystallization wherein there was accomplished an isothermal seeding of the syrup, at the temperature of 55° C., with pure fructose crystals having particle sizes around 60 microns, for 3 hours, in the proportion of 7% by weight of pure fructose seed crystals in relation to the mass of fructose in the syrup. During the seeding there was a slight growth of the seed crystals, thereby having been produced, at the end of this second stage, a massecuite composed of a mass of fructose crystals and an aqueous syrup of fructose and glucose, at the temperature of 55° C.

The third stage consisted in a continuous and slow cooling of this massecuite, at a constant rate of 0.8° C./h, until its temperature was stabilized at a temperature of 51° C. At the end of this stage, the seed crystals had grown moderately and had attained well defined shapes.

In the fourth stage, absolute ethanol at a temperature of 51° C. was added slowly and regularly to the massecuite which was obtained at the end of the preceding stage, for a period of 7 hours, until a weight ratio of the ethanol to the water in the syrup of 1.8 gram of ethanol/gram of water was reached. Consequently, at the end of this stage the crystals suspended in the aqueous alcoholic solution had grown significantly, without the occurrence of any spontaneous nucleation, and had attained sizes with a considerably narrow granulometric distribution.

The fifth stage of the process for the crystallization of fructose consisted in the slow cooling of the aqueous alcoholic massecuite, which was obtained at the end of the preceding stage, from 51° C. to 27° C., at a constant cooling rate of 0.8° C./h. At the end of this stage of slow lowering of the temperature, the fructose crystals exhibited well defined shapes, typical of the orthorhombic crystal system, and achieved sizes especially suitable for their industrial applications. The massecuite temperature was then stabilized at 27° C. for an additional period of 1 hour, after which the crystallization proper, which took 47 hours, was terminated, and there was then initiated the separation of the crystals.

The recovery of the fructose crystals was effected by means of centrifugation of the massecuite, having been this operation significantly facilitated owing to the reduced effective viscosity of the aqueous alcoholic mother liquor, what minimized the fructose losses and contributed to the high process yield. Thereafter, the crystals were adequately washed in the centrifuge proper with cold ethanol at a temperature of 4° C., dried by direct contact with dry air at a temperature of 70° C., until a residual moisture content of at most 0.1% by weight was reached, and were then screened and packed in an environment with controlled temperature and humidity conditions.

The crystalline fructose of high purity manufactured by the process according to the invention, and in accordance with the conditions employed in this example, had the following characteristics:

a fructose content of 99.85% (dsb);

a glucose content of 0.15% (dsb);

a residual moisture content of 0.1% by weight;

an apparent density of 0.53 g/l;

the following granulometric spectrum:

particles with a size greater than 595 microns: approximately 0.8%;

particles with a size greater than 425 microns: approximately 14.8%;

particles with a size greater than 250 microns: approximately 70.3%;

particles with a size greater than 180 microns: approximately 11.4%;

particles with a size comprised between 100 microns and 150 microns: approximately 1.6%;

a mean diameter approximately equal to 295 microns;

a hygroscopicity of 2.8%, at a relative humidity of 80%; and a dissolution time of 12 seconds.

These results indicate clearly that the crystalline fructose prepared as described in this example possesses physical and functional characteristics which are very well adjusted for the desired applications.

Finally, the yield of recovery of the crystalline fructose, for the process parameters and operating conditions employed in this example, attained a value of about 50%, which confirms the effectiveness of the crystallization process according to the invention.

The invention claimed is:

1. A process for the production of a crystalline fructose of high purity, utilizing as raw material the sucrose, comprising:

(a) subjecting an aqueous solution of sucrose having a minimal degree of purity of 99.5% (dsb), and with a dry solids concentration of 60% by weight, to hydrolysis catalyzed by hydrochloric acid, thereby producing a solution of fructose and glucose having a dry solids concentration of 60% by weight, which is then neutralized and deionized;

(b) chromatographing the neutralized and deionized aqueous solution of fructose and glucose having a dry solids concentration of between 58% and 59% by weight at a temperature of between 58° C. and 62° C., to partially separate fructose from the glucose, thereby yielding a solution of fructose and glucose having a dry solids concentration of between 22% and 26% by weight and a fructose content of between 84% and 90% (dsb), which is then evaporated under vacuum, at a temperature of between 59° C. and 61° C., until a dry solids concentration of between 79% and 81% by weight is reached, and concentrating by vacuum evaporation at the same temperature of between 59° C. and 61° C. to obtain an aqueous feed syrup at a temperature of between 59° C. and 61° C., and having a dry solids concentration of at least 92% by weight, a fructose content of between 84% and 90% (dsb) and a glucose content of between 9% and 15% (dsb); and (c) rapidly cooling the aqueous syrup obtained from a temperature of between 59° C. and 61° C. to a temperature of between 52° C. and 58° C., maintaining the temperature constant, and seeding the syrup with crystallization seeds consisting of pure fructose crystals having sizes of between about 40 microns and about 80 microns, for a period of between two hours and four hours, and in the proportion of between 5% and 9% by weight of the mass of pure fructose seed in relation to the mass of fructose in the syrup, to produce a massecuite comprised of a mass of slightly grown fructose crystals and an aqueous syrup of fructose and glucose, (d) subjecting the massecuite to a controlled slow cooling at a constant cooling rate of between 0.7° C./h and 0.9° C./h, until the temperature of the massecuite is stabilized at a value of between about 54° C. and about 48° C., thereby yielding an aqueous massecuite containing moderately grown and morphologically well defined fructose crystals, (e) slowly and regularly adding absolute ethanol at the same temperature as the temperature of the massecuite over a period of between 6 hours and 10 hours, until a weight ratio alcohol to water in the massecuite of between 1.0 and 2.0 grams of ethanol per gram of water is reached, thereby producing an aqueous alcoholic massecuite containing substantially grown crystals, (f) cooling the massecuite slowly from the stabilized temperature of between about 54° C. and about 48° C., to a temperature of between about 30° C. and about 25° C., at a constant cooling rate of between 0.4° C./h and 0.8° C./h, which cooling is followed by an additional period of 1 hour to stabilize the temperature, to obtain fully grown fructose crystals, (g) separating the fully grown fructose crystals from the aqueous alcoholic mother liquor by centrifugation, washing the fructose crystals with cold ethanol at a temperature of 4° C., and drying the fructose crystals by direct contact with dry air at a temperature of at most 80° C., to obtain crystalline fructose of high purity.

2. The process according to claim 1, in which the aqueous solution of fructose and glucose obtained at the end of the chromatographic separation has a fructose content between 86% and 88% (dsb).

3. The process according to claim 1, in which the aqueous solution of fructose obtained at the end of the chromatographic separation has a dry solids concentration between 23% and 25% by weight.

4. The process according to claim 1, in which the aqueous fructose-rich syrup used as the feed for the crystallization stage has a fructose content between 86% and 88% (dsb).

5. The process according to claim 1, in which the aqueous fructose-rich syrup used as the feed for the crystallization stage has a dry solids concentration between 93% and 95% by weight.

6. The process according to claim 1, in which the proportion of the mass of added fructose seed in relation to the mass of fructose in the aqueous syrup is between abut 6% and about 8% by weight.

7. The process according to claim 1, in which the fructose seed crystals have sizes about αmicrons.

8. The process according to claim 1, in which the seed is obtained from about 10% of the mass of the crystals of the crystalline fructose produced by the process proper, in a previous crystallization cycle.

9. The process according to claim 1, in which the ratio of the mass of fructose to the mass of ethanol, in the aqueous alcoholic massecuite, is between about 6 and about 8.

10. The process according to claim 1, in which the recovery of the crystallization aqueous alcoholic mother liquor obtained yields at the end of the massecuite centrifugation an aqueous fructose-rich syrup without any alcohol, having a dry solids concentration between about 60% and about 70% by weight, a fructose content between 74% and 80% (dsb), and a glucose content between 18% and 24% (dsb).

11. The process according to claim 1, in which the alcohol utilized in the crystallization and in the washing of the crystals is recovered to be reused in the process proper, in a subsequent production cycle.

12. Crystalline fructose of high purity produced by the process according to any one of claims 1 to 11, comprising a particulate material that exhibits high fluidity, low friability and crystalline microgranules composed of crystals possessing a morphology similar to that of the othorhombic crystal system; a fructose content higher than or equal to 99.50% (dsb); a glucose content lower than 0.50% (dsb); a residual moisture content lower than 0.12% by weight; an apparent density between about 0.50 g/l and about 0.56 g/l, for a granulometric cut within the range of about 100 microns to about 595 microns; approximately 1% of the particles with a size between about 100 microns and about 150 microns; a mean particle diameter between about 250 microns and about 350 microns; a hygroscopicity lower than 3%; and a dissolution time less than 15 seconds.

13. The crystalline fructose of high purity according to claim 12, having a fructose content higher than 99.70% (dsb).

14. The crystalline fructose of high purity according to claim 12, having a glucose content lower than 0.30% (dsb).

15. The crystalline fructose of high purity according to claim 12, having a residual moisture content lower than about 0.11% by weight.

16. The crystalline fructose of high purity according to claim 12, having an apparent density between about 0.51 g/l and about 0.55 g/l for a granulometric cut within the range of about 100 microns to about 595 microns.

17. The crystalline fructose of high purity according to claim 12, having a hygroscopicity lower than about 2.9%.

18. The crystalline fructose of high purity according to claim 12, having a dissolution time lower than about 12 seconds.

* * * * *